US008720154B1

(12) United States Patent
Horne

(10) Patent No.: US 8,720,154 B1
(45) Date of Patent: May 13, 2014

(54) COLD-FORMED STEEL STRUCTURAL WALL AND FLOOR FRAMING SYSTEM

(76) Inventor: James P. Horne, Golden, CO (US)

( * ) Notice: Subject to any disclaimer, the term of this patent is extended or adjusted under 35 U.S.C. 154(b) by 32 days.

(21) Appl. No.: 13/134,523

(22) Filed: Jun. 8, 2011

Related U.S. Application Data

(60) Provisional application No. 61/397,777, filed on Jun. 17, 2010.

(51) Int. Cl.
*E04H 1/00* (2006.01)

(52) U.S. Cl.
USPC ..... 52/653.1; 52/236.3; 52/262

(58) Field of Classification Search
USPC ..... 52/653.1, 656.1, 481.1, 262, 236.3, 289
See application file for complete search history.

(56) References Cited

U.S. PATENT DOCUMENTS

| | | | | | |
|---|---|---|---|---|---|
| 2,699,669 | A * | 1/1955 | Nelsson | 52/481.1 |
| 2,909,251 | A * | 10/1959 | Nelsson | 52/238.1 |
| 3,292,328 | A * | 12/1966 | Darling et al. | 52/238.1 |
| 3,483,665 | A * | 12/1969 | Miller | 52/461 |
| 4,047,348 | A * | 9/1977 | McSweeney | 52/506.06 |
| 4,058,951 | A * | 11/1977 | Dean | 52/656.1 |
| 4,835,935 | A * | 6/1989 | Murphy | 52/281 |
| 4,850,169 | A * | 7/1989 | Burkstrand et al. | 52/241 |
| 4,951,436 | A * | 8/1990 | Burkstrand et al. | 52/241 |
| 5,048,257 | A * | 9/1991 | Luedtke | 52/747.1 |
| 5,647,186 | A * | 7/1997 | Donaldson | 52/653.1 |
| 5,687,538 | A * | 11/1997 | Frobosilo et al. | 52/846 |
| 6,301,854 | B1 * | 10/2001 | Daudet et al. | 52/650.1 |
| 6,360,510 | B1 * | 3/2002 | Woodrum et al. | 52/481.1 |
| 6,374,558 | B1 * | 4/2002 | Surowiecki | 52/241 |
| 6,418,694 | B1 * | 7/2002 | Daudet et al. | 52/650.1 |
| 6,691,478 | B2 * | 2/2004 | Daudet et al. | 52/289 |
| 6,761,005 | B1 * | 7/2004 | Daudet et al. | 52/272 |
| 6,988,347 | B2 * | 1/2006 | Nanayakkara | 52/855 |
| 7,216,465 | B2 * | 5/2007 | Saldana | 52/655.1 |
| 7,223,043 | B1 * | 5/2007 | Andrews | 403/363 |
| 7,231,742 | B2 * | 6/2007 | Majlessi | 52/167.3 |
| 7,240,459 | B2 * | 7/2007 | Daudet et al. | 52/289 |
| 7,461,494 | B2 * | 12/2008 | Frezza | 52/846 |
| 7,712,266 | B2 * | 5/2010 | Sarkisian | 52/167.1 |
| 7,716,899 | B2 * | 5/2010 | Beck et al. | 52/741.13 |
| 7,797,901 | B2 * | 9/2010 | Near | 52/481.1 |
| 7,849,649 | B2 * | 12/2010 | Tonyan et al. | 52/483.1 |
| 7,856,786 | B2 * | 12/2010 | Beck et al. | 52/650.1 |
| 8,091,316 | B2 * | 1/2012 | Beck et al. | 52/650.1 |
| 2009/0188208 | A1 * | 7/2009 | Studebaker et al. | 52/852 |
| 2010/0218451 | A1 * | 9/2010 | Andrews | 52/653.1 |
| 2011/0113715 | A1 * | 5/2011 | Tonyan et al. | 52/483.1 |

* cited by examiner

*Primary Examiner* — Andrew J Triggs
(74) *Attorney, Agent, or Firm* — Edwin H. Crabtree; Ramon L. Pizarro

(57) ABSTRACT

A cold-formed steel structural wall and floor framing system used for the construction of commercial and residential buildings. The framing system includes a plurality of horizontal, elongated, top and bottom spanning tracks. The spanning tracks are used for supporting a plurality of spaced apart vertical wall studs. Also, the spanning tracks are used to support a plurality of different floor systems, including but not limited to spanning steel floor decks with a concrete floor topping, composite floor joists, steel or wood joists, roof trusses and window and door headers.

17 Claims, 9 Drawing Sheets

33
47
34
32
55
48
47

37
14
30
47
50
54
12
55
49
48
6D
6D
31
10
47
30
48
52
61
61
14
36
6B
55
32
34
33
34
50
32
12
6B
48
47
51
49
55
30
55
48
47

COLD-FORMED STEEL STRUCTURAL WALL AND FLOOR FRAMING SYSTEM

This non-provisional patent application claims the benefit of an earlier filed provisional patent application, filed on Jun. 17, 2010, Ser. No. 61/397,777, having a title of "Wall and Floor Framing System" by the subject inventor.

BACKGROUND OF THE INVENTION (a) Field of the Invention

This invention relates to a wall and floor system for building construction and more particularly but not by limitation to a cold-formed steel structural wall and floor framing system used in commercial and residential buildings.

(b) Discussion of Prior Art

Now and in the past, cold formed steel, also referred to as light gauge steel, wall stud and floor joist framing has been used extensively, in particular for exterior curtain wall and interior non-bearing construction, primarily as replacement for wood stud framing used for partition walls and ceiling support framing in buildings where combustible materials are not permitted by building codes. More recently, cold formed steel bearing construction has been increasingly used as the structural load resisting elements for single and multi-story buildings, up to 9 or more stories.

Structural steel stud framing is manufactured in the United States using a minimum of 25% recycled steel, which is an advantage when considering the movement towards energy efficient construction and sustainable design. Further, steel stud framing and steel components are 100% recyclable upon a building's future demolition. Steel stud framing systems are straight and dimensionally accurate and consistent without material imperfections common in wood, concrete, and masonry, and can be manufactured to any required length during fabrication that is practical for shipping and erection.

Pre-assembled wall panels of studs and track can be shop fabricated and delivered to the construction site to be erected as pre-assembled units, saving construction time, labor, and on-site scrap and waste. Cold formed steel structures are lighter, more environmentally friendly, and take less skilled labor to construct than similar structures built using structural masonry, reinforced or pre-cast concrete bearing wall structures. A lighter structure has several advantages, such as lower weight for transportation costs, lighter and smaller foundations, and lower seismic forces, as seismic forces are directly proportional to building self weight. In high seismic areas, lower seismic forces further reduce cost of lateral frames, connections and collectors, as well as size and intricacy of foundations supporting lateral frames. Therefore, a lighter structure saves materials, labor, shipping, and complexity, creating a much more efficient structure and lower overall environmental impact than a heavier structure constructed with pre-cast floor planks, or masonry or concrete bearing walls.

Heretofore, there have been a large number of issued patents related to cold-formed, steel building structures, components, prefabricated assemblies and prefabricated structures. These patents disclose various structural components including the use of cold formed steel structural studs, track, joists and bridging, which have been used as standard construction materials for nearly 50 years.

The patents include U.S. Pat. No. 1,981,240 to Mcneil, U.S. Pat. No. 5,720,138 to Johnson, U.S. Pat. No. 5,274,973 to Liang, U.S. Pat. No. 5,647,186 to Donaldson, U.S. Pat. No. 6,519,911 to Sawada, U.S. Pat. No. 5,113,631 to diGirolamo et al., U.S. Pat. No. 4,716,695 to Alexander et al., U.S. Pat. No. 5,782,047 and U.S. Pat. No. 6,298,617 to De Quesada, U.S. Pat. No. 5,941,035 to Purse, U.S. Pat. No. 5,881,516 to Luedtke, U.S. Pat. No. 6,799,408 and U.S. Pat. No. 7,178,304 to Brady, D467,007 to Daudet et al., U.S. Pat. No. 4,075,810 to Zakrzewski et al., U.S. Pat. No. 4,130,970 to Cable, U.S. Pat. No. 4,161,087 to Levesque, Ser. No. 12/548,694 to Beck et al, Ser. No. 12/505,478 to Wing-Chow Siu, U.S. Pat. No. 5,479,749 to Colasanto et al, U.S. Pat. No. 5,412,919 to Pellock et al, and U.S. Pat. No. 7,739,850 to Daudet.

None of these prior art references disclose the unique combination of structure and features of the subject cold-formed steel structural wall and floor framing system. In particular, the above mentioned patents don't teach or suggest a system having top and bottom spanning tracks used to distribute point loads from wall studs and floor joists to offset supporting wall studs and floor joists indexed below.

SUMMARY OF THE INVENTION

A key object and advantage of the wall and floor system is the invention allows for simplification of current construction practices, reduces and/or eliminates problematic issues such as dimensional difficulties during pre-fabrication of structural panels, decreases coordination of construction scheduling and phasing of different building trades during construction, and reduces settlement of the building structure during and after construction due to fabrication tolerances.

Another object of the invention is the system allows for stacking of wall panels during construction prior to placing concrete floors, thereby avoiding mixing of construction materials, contractors and labor trades in terms of critical path sequencing of construction.

Still another key object of the invention is the system allows for elimination of heavy load distributor elements at the top of bearing walls to transfer point loads from above to offset supporting stud framing below, by utilizing spanning track elements at top and bottom of walls. Due to the load distributing capability of the spanning tracks, floor systems can be pre-panelized prior to delivery to the jobsite to reduce labor time on site and allow for the majority of floor and roof construction on the ground as opposed to framed in place, thereby also improving jobsite safety. Mechanical, electrical, and plumbing utilities can be installed prior to placing concrete topping, greatly aiding construction phasing and greatly reducing the need to drill or core through concrete floors for utilities after placing concrete.

The proposed bearing wall system is compatible with several structural floor and roof framing systems, including spanning composite deck, cold formed steel joists, structural steel joists, wood joists, proprietary joist systems, prefabricated wood or steel trusses, proprietary floor joists, roof trusses, as well as a newly proposed composite joist system described in the art. The proposed composite joist system can be considered to act compositely with structural concrete topping using custom self drilling screws, designed to transfer joist chord compression into the concrete topping. Composite action greatly increases the floor framing rigidity, thereby reducing the weight of joist steel. Spanning floor elements can be supported either on the top of the spanning track, or the lower seat located at top of stud elevation. Note that when large concentrated loads such as from joists or beams are supported by the lower seat of the spanning track, the joist or beam must be directly connected to the spanning track vertical web through a welded or screwed connection to avoid over-loading the lower seat element, which is not adequate to support concentrated bearing loads.

Utilizing top flange supported joists also allows for a more continuous wall system, reducing sound transmission through floor joist interstitial space across walls, as this space is essentially eliminated.

Yet another object of the invention is a proposed shear wall system for resistance to lateral loading. The shear wall system consists of two lateral force resisting elements, diagonal flat steel straps and vertical steel sheet shear wall panels at ends. Straps are screwed or welded to the steel sheet shear wall panels at ends, which also serve to act as gusset plates for strap end connections. Steel sheet shear wall elements transfer strap tension load to horizontal track and vertical studs through screwed or welded connections. The steel sheet shear panels at wall ends will maintain some strength, stiffness, and energy dissipation throughout the building frame lateral cycle after tension strap yielding elongation during the design earthquake loading. Steel sheet shear panels also provide temporary lateral bracing for lateral stability during construction, prior to fastening the straps each end. Uplift restraint hold down anchors compatible with the spanning track bearing wall system are located at shear wall ends. Studs and hold-down anchors are positioned at each end of the steel sheet shear wall to resist overturning uplift from the shear wall panel as well as resist global shear wall overturning tension and compression forces. Horizontal blocking may be used behind steel sheet sheathing at regular intervals to obtain higher strength by restraining local buckling. Straps and steel sheet shear panels may be located on one side or both sides of the shear wall studs.

Shear walls can be strategically situated around the perimeter of a multi-story building to provide redundancy within a vertical gravity load carrying system. This feature can provide resistance to progressive collapse from explosion, or blast loading. Today, most federal and military buildings as well as an increasing number of state facility buildings are required to meet design standards for preventing progressive collapse due to blast loading.

The subject cold-formed, steel structural wall and floor framing system broadly includes a plurality of horizontal, elongated, top and bottom spanning tracks. The tracks are used for supporting a plurality of spaced apart vertical studs. Also, the tracks are used to support steel floor decks with concrete topping, floor joists, roof trusses and window and door headers.

BRIEF DESCRIPTION OF THE DRAWINGS

The accompanying drawings illustrate complete preferred embodiments in the present invention according to the best modes presently devised for the practical application of the proposed wall and floor framing system as described herein.

DETAILED DESCRIPTION OF THE PREFERRED EMBODIMENTS

Figure 1:
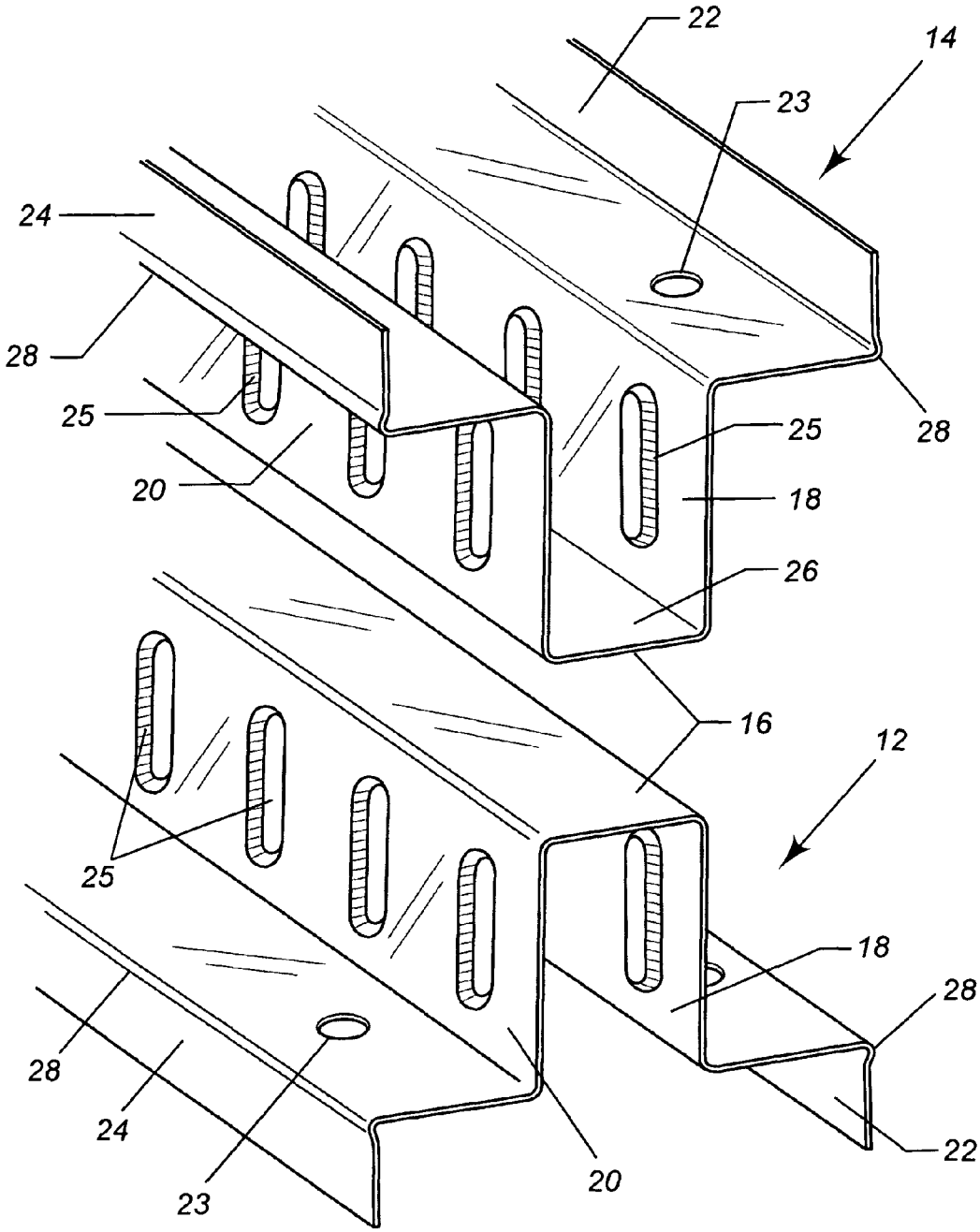
FIG. 1 illustrates a perspective view of a portion of the wall and floor system's horizontal, upper and lower spanning tracks

In the following drawings, the subject cold-formed steel structural wall and floor framing system is shown having general reference numeral 10. Although there are several advantages using cold formed steel construction, several obstacles have prevented this construction method from gaining popularity throughout the United States. The following discusses three reasons why the subject wall and floor framing system 10 was developed over existing cold-formed steel building construction.

First, currently there are limited effective options using cold formed steel systems alone without using thicker structural steel elements or other materials to evenly distribute gravity forces between studs at top of bearing walls, in the condition where point loads occur in between studs, or stud or joist framing above bearing walls are offset from supporting stud framing below. Some prior wall and floor systems are limited due to lower than required capacity, use of construction materials from other trades such as structural rolled steel shapes or hollow tube steel shapes, or use of rigid floor systems such as precast planks that serve to span between studs below. In the drawings, top and bottom spanning tracks in the subject system 10 utilizes a cold formed steel section, maintaining all construction within the same building trade of cold formed steel without adding other trades, allowing for easier and more economical prefabrication. Also, the spanning tracks allow for non-aligning floor joists, and studs above and below a floor system, which typically must be aligned throughout the height of the building over all stories within ⅛", thus creating construction tolerance difficulties and frequent field strengthening and correction of misalignments after erection.

Second, due to an inside radius of typical "runner" or "U" top and bottom tracks, a gap up to ⅛" is permitted by the building code and cold formed steel design standards between the top and bottom of studs and the track bearing surface. During construction loading, this gap compresses through local yielding of the track and/or studs, causing large overall panel deformation and settlement. In a multi story building, this ⅛" gap located at the top and bottom of bearing walls over several stories can add up to over an inch or more of settlement. In some cases, panel elements and connections have been damaged or fractured due to this compression displacement during construction, requiring structural repairs on site. To limit this effect, manufacturers utilize pre-compression or shims to try to limit the gap between studs and track. The subject wall and floor system 10 provides for a full bearing surface on the top and bottom of the wall studs, eliminating the ⅛" gap between the studs and the bearing surface. This feature eliminates the corresponding deformation under loading, and the requirement of pre-compression, shimming, or structural repairs on site.

Third, the new wall and floor framing system 10 allows for a variation of the top spanning track to be used for the bottom spanning track of the structural walls, creating the ability to stack cold formed steel prefabricated panels prior to placing concrete floors. It is often difficult to obtain a completely level surface for bearing of cold formed steel wall panels, which require shims under the panels with steel plates or non-shrink grout. Also, precast planks can be manufactured to different tolerances between adjacent planks, requiring shimming or other field adjustments. For multi-level building construction, current construction practices typically require shimming or grouting for level surface at each floor level. The subject wall and floor system allows for shimming only at the lowest level at base of wall, placing the base spanning track over the top of a concrete foundation, eliminating the requirement for a completely level supporting surface, which is often also difficult to achieve in practice and in particular for foundation construction which typically has a larger construction tolerance than floors. The use of the spanning track as a bottom spanning track provides additional tolerance in terms of full bearing at each stud, regardless of the levelness of the supporting structure. Above the lowest bearing level, the subject wall and floor framing system is connected between panels and floors, not to concrete, completely eliminating shimming or levelness issues at upper stories.

In FIG. 1, two key structural elements of the wall and floor framing system 10 are shown. The elements are an inverted "U" shaped, elongated, horizontal, cold-formed, steel top spanning track, having general reference numeral 12 and a similar "U" shaped, elongated, horizontal, cold-formed, steel bottom spanning track, having general reference numeral 14. The top spanning track 12 is an inverted version of the bottom spanning track 14.

The top spanning track 12 includes a horizontal top portion 16, first and second vertical sides 18 and 20, and integrally formed "L" shaped, first and second flanges 22 and 24. The top portion 16 and the flanges 22 and 24 may include holes 23 therein for placement of reinforcing bars or electrical conduit. Also, the vertical sides 18 and 20 may include elongated indentations, or embossments 25 that allow for composite action between the spanning tracks and structural concrete fill when placed in contact.

The bottom spanning track 14 includes a horizontal, bottom portion 26, first and second vertical sides 18 and 20 and integrally formed "L" shaped, first and second flanges 22 and 24. The flanges 22 and 24 as well as vertical sides 18 and 20 may also include holes 23 therein, as well as elongated embossments 25 in the vertical sides 18 and 20. It should be noted that an outwardly, deformed flange corner 28 in the flanges 22 and 24 is provided for allowing full bearing of vertical studs received inside the spanning tracks 12 and 14. The vertical studs are shown in the following drawings.

Figures 2, 3:
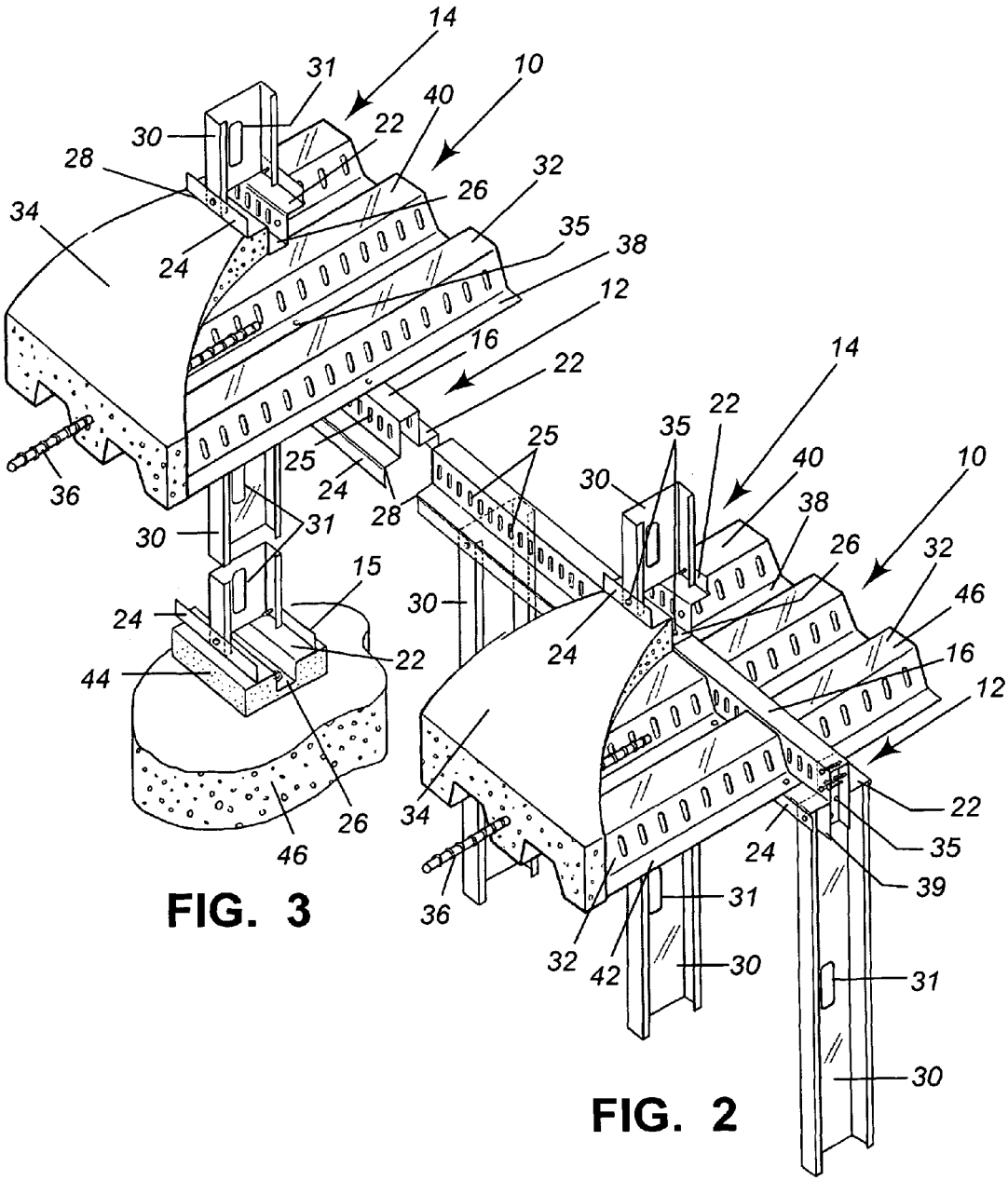
FIG. 2 shows the upper and lower spanning tracks supporting a plurality of vertical wall studs and interrupted discontinuous floor deck with concrete floor topping.
FIG. 3 is similar to FIG. 2 and illustrates the spanning tracks supporting wall studs and continuous steel floor deck running overtop the spanning top track with concrete floor topping.

In FIG. 2, a perspective drawing of the wall and floor framing system 10 is shown with the spanning tracks 12 and 14 receiving either a top portion or bottom portion of spaced apart, "C" shape in cross-section, cold formed, vertical, steel bearing wall studs 30. The studs 30 include elongated holes 31 for receiving structural bracing components, as well as electrical wiring, plumbing pipe and like utilities therethrough. Three of the studs 30 are shown with the upper portion of the studs screwed to the flanges 22 and 24 of the top spanning track 12 with self drilling screw fasteners 35. Also, an upper stud 30, indexed on top of a lower stud 30 is shown screwed to the flanges 22 and 24 of the bottom track 14. The majority of structural connections shown in this and other figures are accomplished with self drilling screws 25.

In this drawing, one of the system's floors is shown with a pair of corrugated, steel floor deck 32. The floor decks 32 are disposed on opposite sides of the top spanning track 12 and bolted to the track's first and second flanges 22 and 24. In this floor system, a concrete floor topping 34 is poured over the floor deck 32. The topping 34 typically includes rebar 36 located overtop deck valleys 38 in the deck's corrugations for added floor strength. The concrete topping 34, in this illustration, extends upwardly from the bottom of the valleys 38, above the top of ridges 40 in the deck's corrugations, and up to or above the bottom of the bottom spanning track's flanges 22 and 24. The floor deck 32 valleys 38 in the corrugations are fastened to the top portion 16 of the top spanning track 12 with self drilling screws 35.

It should be noted in this drawing, the bottom portion 26 of the bottom spanning track 14 rests on top of the top portion 16 of the top spanning track 12 and is fastened thereto with screws 35, thus eliminating the need for shimming to level the spanning tracks during the installation of the wall and floor system 10.

Top spanning track 12 is shown affixed at the end to a track stiffener 39 and to the supporting stud 30 at the end of the spanning track 12, to prevent buckling and or web crippling failure. It should be noted that studs 30 must be rotated at ends of spanning track sections such that end of spanning track 12 does not align with stud web with holes 31 to prevent loss of bearing support for the spanning track.

In FIG. 3, another perspective view of the wall and floor framing system 10 is illustrated and similar to FIG. 2. In this example, the steel floor deck 32 extends below and across the bottom spanning track 14 and above and across the top spanning track 12. In this example, the bottom of the deck 32 is attached to the top portion 16 of the top spanning track 12. Also, the bottom portion 26 of the bottom spanning track 14 rests on and bears on top of the deck 32 with the concrete topping 34 poured under the flanges 22 and 24 of the track 14 for bearing support of studs 30 above.

Also shown in this drawing is a bottom portion of a lower vertical stud 30 resting on and attached to a portion of a base spanning track 15. The base track 15 bears on a base of leveling grout 44, and is fastened through the leveling grout 44 which is disposed on the building's concrete foundation or concrete slab base 46.

Figure 4:
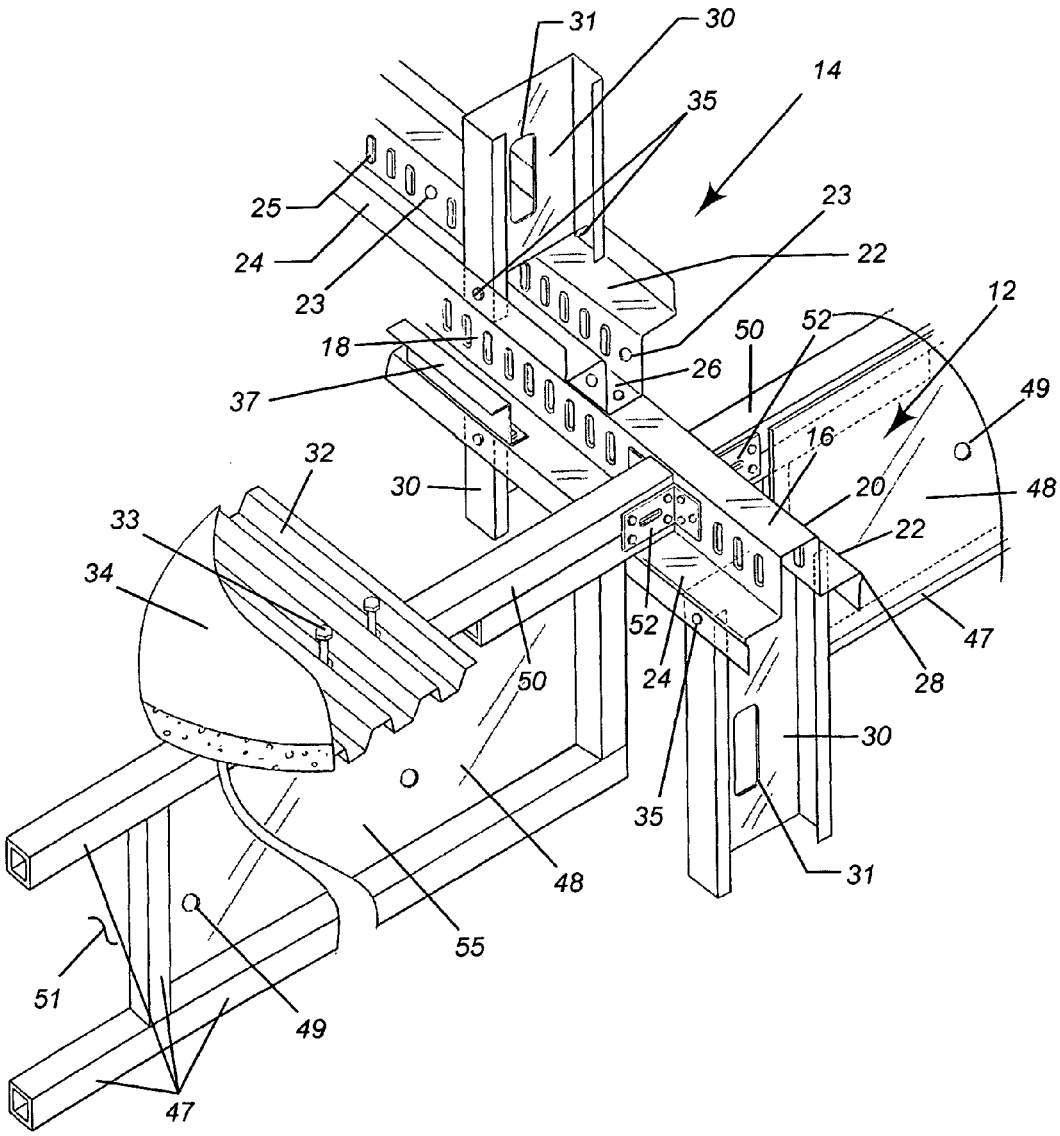
FIG. 4 is another perspective view of the wall and floor system illustrating the upper and lower spanning tracks supporting the wall studs and a pair of compatible composite floor joists with a steel floor deck with concrete floor topping.

In FIG. 4, still another perspective view of the wall and floor system 10 is shown and similar to FIG. 2. In this drawing, the bottom portion 26 of the bottom spanning track 14 is shown resting on and screwed to the top portion 16 of the top spanning track 12. A pair of horizontal, composite floor joists 48 are shown having joist hanger arms 50 resting during erection on flanges 22 and 24 of the top spanning track 12. The hanger arms 50 are structurally supported by "L" hanger brackets 52 for securing the joists 48 to the vertical sides 18 and 20 of the top spanning track 12.

Also illustrated in this drawing is one of the composite floor joists 48 supporting a portion of a steel deck 32 and concrete floor topping 34. Composite joists 48 are made structurally integral with composite floor slab through self drilling composite screws 33. Composite joists 48 are constructed with a tube steel frame 47, and steel sheet vertical web 55. Web 55 has holes 49 for small pipes or electrical conduit. Web 55 is omitted at center of joist span 51 to allow large pipes or ducts to pass perpendicular to joists. It can be appreciated that the deck 32, when extended and fastened to steel "Z" closure 37 with screws 35, the concrete floor topping 34 would be poured up to and under the flanges 22 and 24 for completing the floor system.

The top and bottom spanning tracks 12 and 14, shown in the drawings, can be fabricated with or without the holes 23 or stamped embossments 25. When stamped embossments 25 are provided, the deck 32 with the concrete topping 34 is used to form a composite structural beam at the top and/or bottom of the wall once the concrete topping is in place. Of course, if concrete is not used, a plywood floor, a bare deck, or a non-structural floor topping materials can be used as a finished floor surface. Also, the spanning tracks 12 and 14 can be manufactured with the pre-punched bolt holes 23 at regular intervals within spanning track flanges 22 and 24, or vertical web 18 and 20 for installation of electrical conduit, steel reinforcing bars, hold down anchor rods, or to allow concrete and or grout to flow through the bottom spanning track 14. Further, the spanning tracks can be strategically drilled to create holes 23, for placement of concrete reinforcing or anchor bolts if not pre-punched. At the ends of walls, where the spanning tracks terminate, a stud stiffener 39 is provided as shown in FIG. 2 and attached to the spanning tracks 12 and 14 and studs 30 to prevent lateral sideway buckling of the spanning tracks and increased web crippling strength at the free end.

Figure 5A:
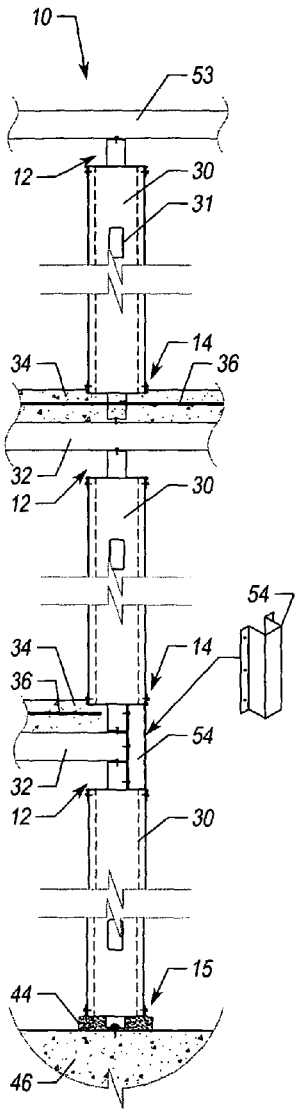
FIG. 5A-5E show front views of different configurations of the top and bottom spanning tracks with floor deck and concrete topping.
Figure 5B:
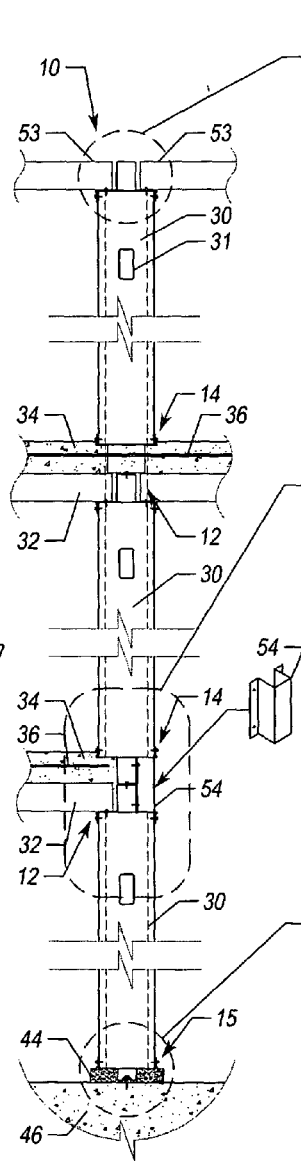

In FIGS. 5A-5E, side views of the top and bottom portions of the vertical wall studs 30 are shown engaging different configurations of the top and bottom spanning tracks 12 and 14 along with different configurations of the steel floor deck 32 and concrete floor topping 34, as shown in FIGS. 2 and 3. FIGS. 5A and 5B illustrate a portion of a multi-story building incorporating the subject wall and floor framing system 10.

In FIG. 5A, the ground floor and the second floor show the floor deck 32 disposed between the top and bottom spanning decks 12 and 14, similar to FIG. 3. At the exterior wall condition shown, a "U" shaped, cold-formed steel stud spacer 54 or stiffener is used to cover the space between the top and bottom of the adjacent studs 30 for strengthening, used only if required by structural designs. The spacer's flanges 22 and 24 are screwed to the vertical side 18 of the spanning tracks 12 and 14 with self drilling screws 35. At the roof level, the top spanning track 12 engages and supports horizontal roof deck 53.

FIG. 5B is similar to FIG. 5A, but in this example, the bottom portion 26 of the bottom spanning track 14 rests on the top of the top portion 16 of the top spanning track 12, similar to FIG. 2. Because the vertical distance between the bottom and top of the adjacent studs 30 is now less, the length of the stud exterior wall stiffener 54 is less.

Figure 5E:
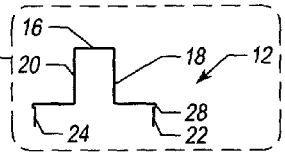
Figure 5C:
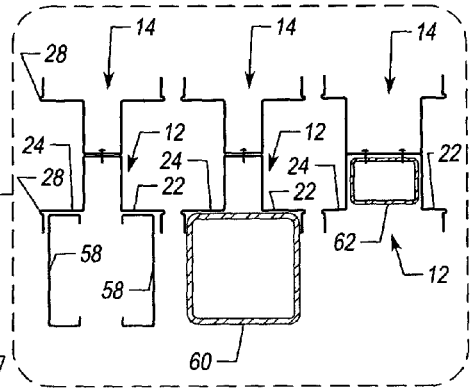

FIG. 5C is an enlarged view of the top spanning track 12 with flanges 22 and 24 used to engage a floor joist in the form of a pair of adjacent "C" channel joists 58, a tubular square joist 60 or a smaller, tubular rectangular joist 62, which represent options for creating structural headers spanning over windows or doors in the wall system below.

Figure 5D:
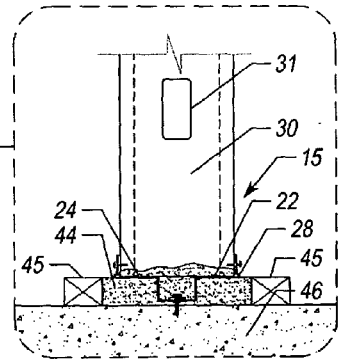

FIG. 5D is an enlarged view of the base track 15 used to secure the bottom of the studs 30 to the concrete floor slab or foundation 46, showing leveling grout 44 and forms for leveling grout 45. FIG. 5E is an enlarged view of the top spanning track 12 used to support opposite sides of the roof deck 53, shown in FIGS. 5A & 5B.

In FIG. 6A-6F, side views of the wall and floor framing system 10 are shown and similar to the system 10 described in FIG. 4, but with different configurations of the composite floor joist 48 or "C" shaped channel joist 64 suspended between adjacent vertical studs 30 and attached to the top or bottom spanning tracks 12 and 14.

Figures 6A, 6B, 6C, 6D:
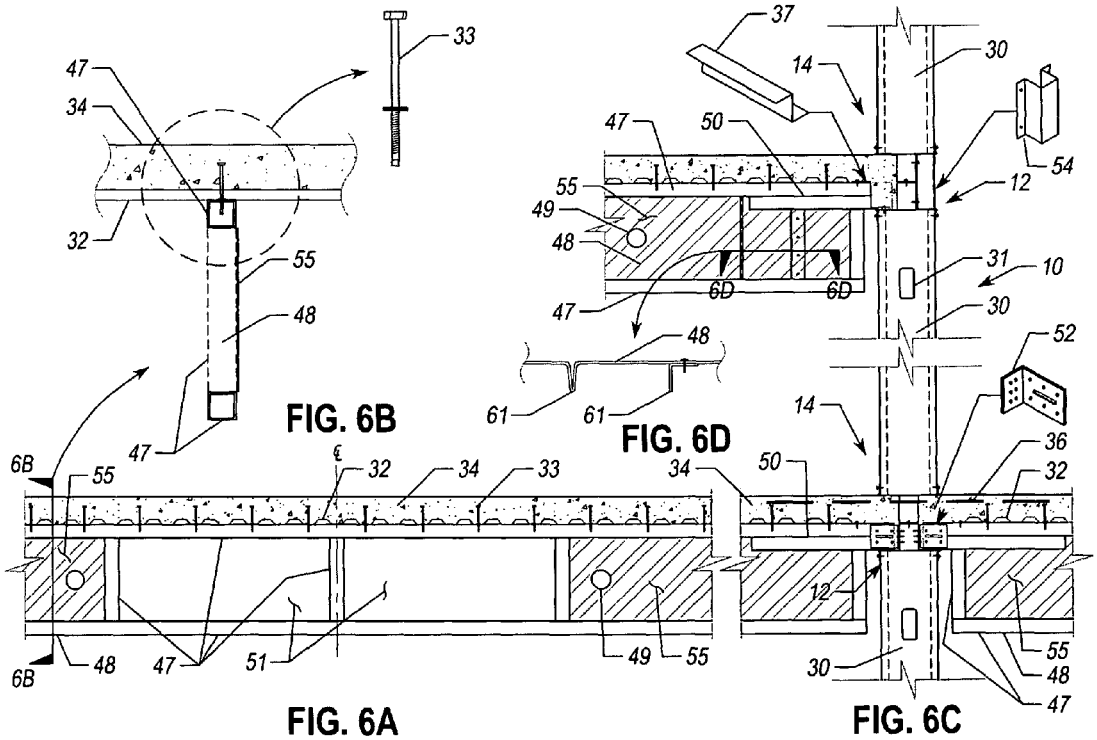
FIG. 6A-6F illustrates front views of different configuration of the top and bottom spanning tracks with suspended floor joists and joist hanger arms.

FIG. 6A illustrates a portion of the composite floor joist 48 with the steel floor deck 32 attached to the top of the joist with composite self drilling screws 33. Also, the concrete floor topping 34 is shown poured on top of the deck. Details of the tube steel frame 47, steel sheet vertical joist web 55, web holes 49, large center openings in steel sheet web 51, and composite fasteners 33 are shown. Composite joist web 55 can be stiffened for additional shear strength with web stiffeners 61 by using pre-formed ridges, web corrugations, or fastened "L" stiffeners. In FIG. 6B, an enlarged cross-sectional view of the joist 48 is shown taken on lines 6B-6B, in FIG. 6A. In this drawing, self drilling composite screws 33 are shown as well as floor deck 32 and concrete fill 34, joist tube steel top and bottom chord frame 47 and steel sheet web 55.

FIG. 6C shows a lower portion of the system 10 with a pair of the floor joists 48 attached to the vertical sides 18 and 20 of the top spanning track 12 using double "L" shaped hanger brackets 52, one each side of the composite joist hanger arm 50. In an upper portion of the system 10, which shows the condition between joists, the floor deck 32 is attached to a "Z" shaped closure bracket 37. The bracket 37 is also attached to the flange 24 of the bottom spanning track 12 to allow for continuous diaphragm shear load path. FIG. 6D is a cross-sectional view of a portion of the joist 48 taken along lines 6D-6D, shown in FIG. 6C. The joist 48, in this example, is constructed having a tube steel frame 47 with steel sheet web vertical paneling 55 which can be stiffened 61 for additional shear strength as shown.

Figures 6E, 6F:
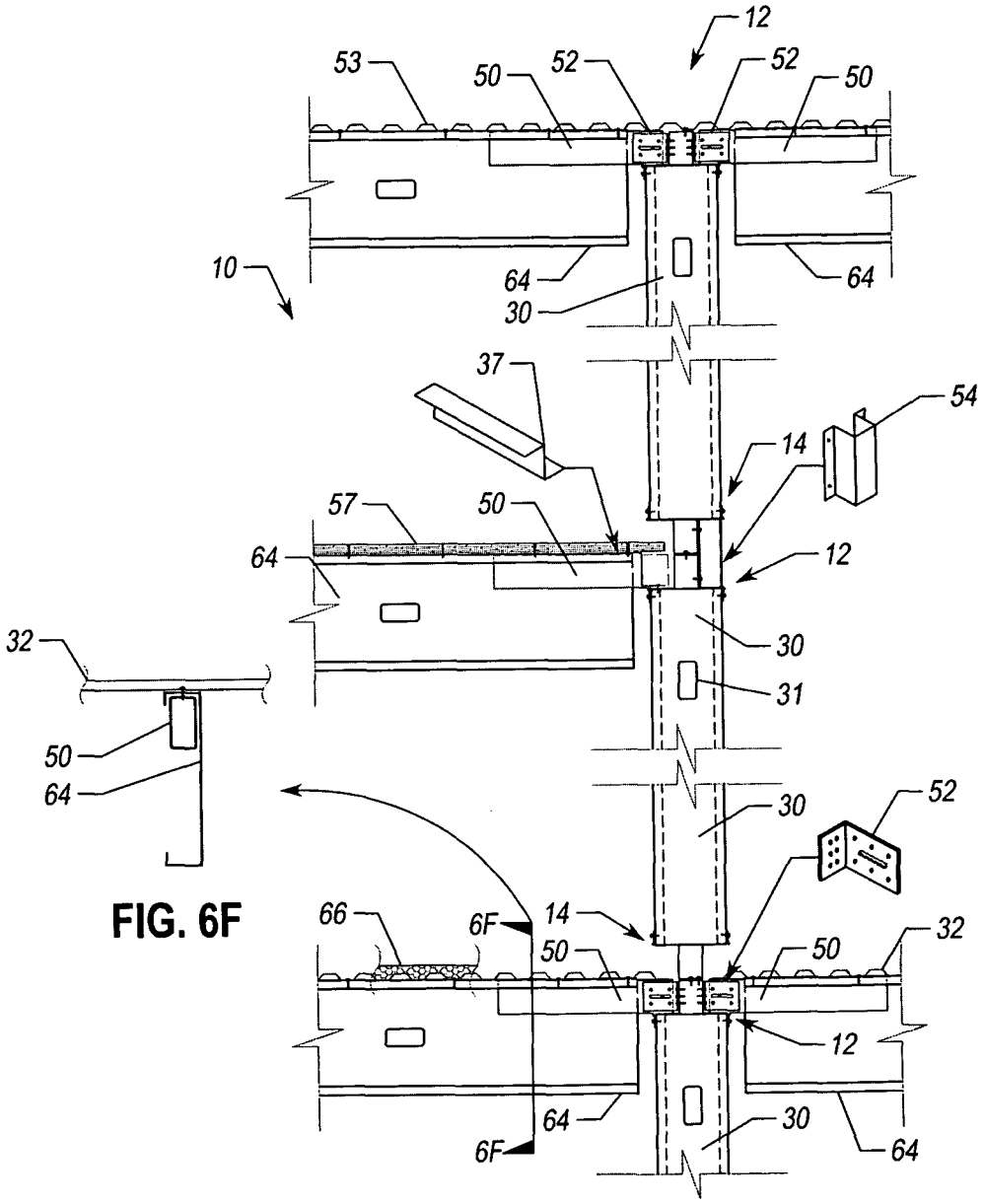

In FIG. 6E, the wall and floor framing system 10 is shown having a plurality of floor joists 64 with joist hanger arms 50 attached to the top spanning track 12 using "L" shaped hanger brackets 52. Note that floor joists 64 in this instance are standard "C" type cold formed steel joists which can be modified by affixing hangar arms 50 to joist ends, to make joists compatible with the spanning track configuration. Similarly, wood joists or structural steel joists could be used in lieu of standard "C" cold formed steel joists, provided a top flange hanger connection is utilized. Alternatively wood or steel joists similar to 64 could be run continuous over top of spanning track top portion 16. Though these alternate and other possible floor systems are not specifically shown, they are mentioned to elucidate the compatibility of the bearing wall system 10 with many possible floor framing schemes. FIG. 6F is a cross-sectional view of a "C" shaped joist 64 with hanger arm 50 taken along lines 6F-6F, shown in FIG. 6E.

In FIGS. 7A-7H, the wall framing system 10 is illustrated using the wall stud 30 and attached top spanning track 12 to support one end of various roof trusses and roof joists.

Figure 7A:
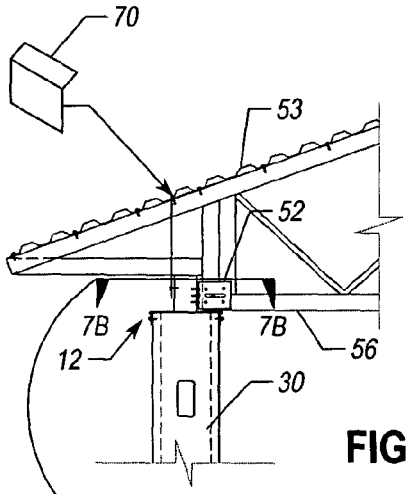
FIG. 7A-7H show fronts views of different types of roof trusses attached to the top spanning track on a vertical wall stud.

FIG. 7A shows the use of the "L" shaped hanger bracket 52 located each side of the horizontal roof truss 56, attached to the vertical side 18 of the top spanning track 12 using self drilling screws 35. The roof truss 56, in this example, is shown supporting roof deck 53, attached with self drilling screws 35. Steel sheet collector 70 connects the roof deck 53 diaphragm to supporting top track 12 below for lateral loading transfer.

Figure 7B:
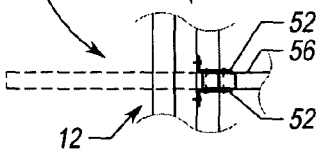

FIG. 7B is a cross-sectional view, taken along lines 7B-7B in FIG. 7A, of a top view of the top spanning track 12 attached to both sides of the roof truss 56 using the "L" shaped hanger brackets 52.

Figure 7C:
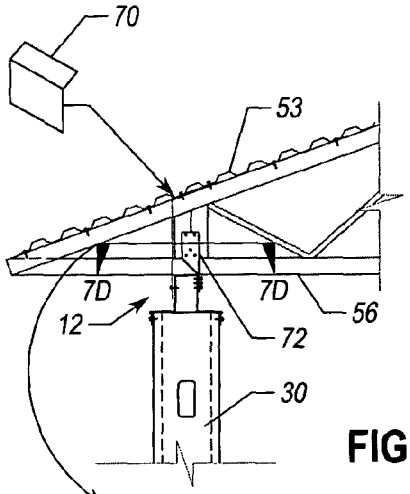
Figure 7D:
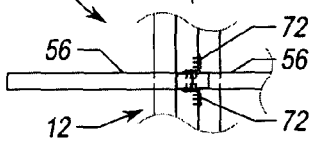

FIG. 7C, similar to FIG. 7A, illustrates the roof truss 56 extending across and on top of the top portion 16 of the top spanning track 12 and resting thereon. The truss 56 is attached to the sides of the spanning track 12 using a truss connector bracket 72 each side, as shown in FIG. 7D.

Figure 7E:
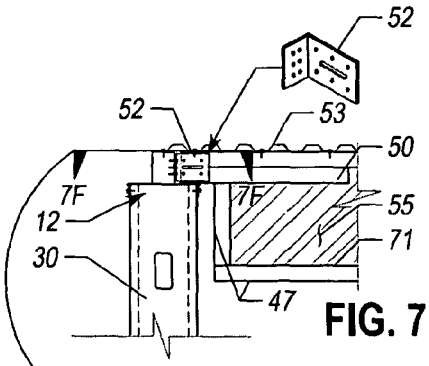
Figure 7F:
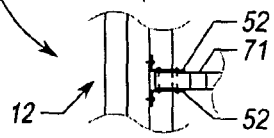

FIG. 7E illustrates a flat roof condition using roof joists 71 similar to composite floor joists 48 per FIG. 4 & FIGS. 6A-D. Roof joists 71 support roof deck 53. The hanger arm 50 is attached to the sides of the spanning track using the "L" shaped hanger brackets 52, as shown in FIG. 7F.

Figure 7G:
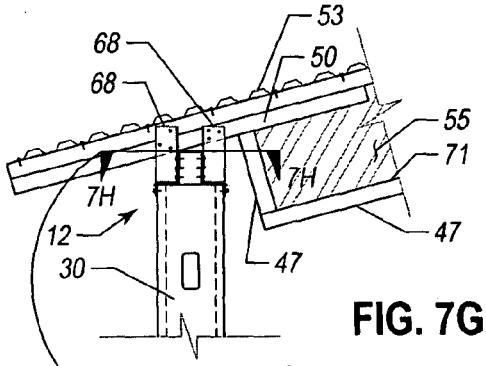
Figure 7H:
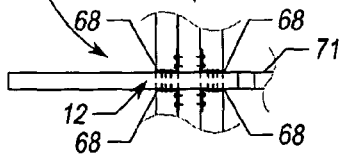

FIG. 7G shows a roof joist 71 similar to FIG. 7E used in a pitched roof condition with a cantilevered overhang. In this drawing, the hanger arm 50 is attached to both sides of the top spanning track 12 using elongated, "L" shaped truss connection angles 68 at four locations, as shown in FIG. 7H. Truss connection angles 68 may be appropriate at two locations only, either at an inside or outside part of the wall. Roof joists 71 in both FIG. 7E and FIG. 7G. are constructed similarly to composite floor joists 48, with tube steel frame 47 and sheet steel vertical web 55, as described in FIG. 6A-6D.

Figure 8A:
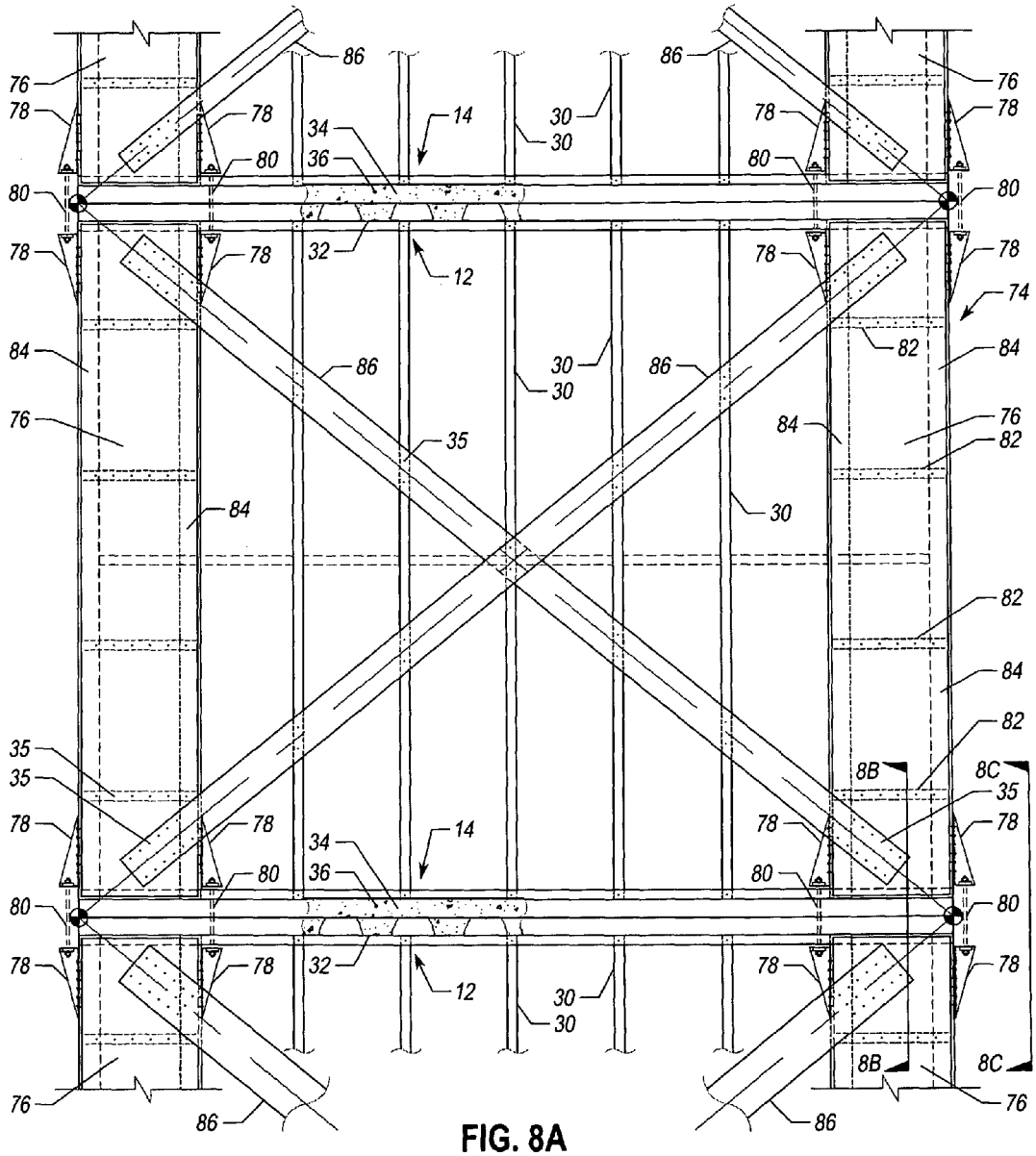
FIG. 8A-8D illustrate a front elevation view of a shear wall panel using the subject wall and floor framing system and cross-sectional views of portions of the wall panel.

In FIG. 8A, a front elevation view of a shear wall panel is shown and having general reference numeral 74. In this view, the shear wall panel 74 includes a pair of vertical steel sheet shear wall end panels 76, using steel sheet sheathing on each side of the panel. Each end of the end panels 76 is supported by shear wall boundary studs 84, which are larger studs to resist overturning forces within the end panels 76 and the shear wall panel 74 as a whole. Horizontal stud blocking 82 is utilized within the steel sheet shear wall end panels 76 for additional strength, screwed through sheet sheathing with self drilling screws 35. Sheet steel sheathing is welded to boundary studs 84 and top and bottom spanning tracks 12 and 14. In between the two wall end panels 76 are a plurality of spaced apart, vertical wall studs 30 disposed between the two end panels. The opposite ends of the end panels 76 and the studs 30 are attached to the top and bottom spanning tracks 12 and 14. The top and bottom of the panel 74 includes a floor system made up of the steel floor deck 32 and the concrete floor topping 34 received between the spanning tracks, with reinforcing bars 36 located above deck valleys 38 for additional strength. For added strength and stiffness, the panel 74 includes diagonal, flat steel strap cross bracing 86 with opposite ends of the bracing fastened with self drilling screws 35 or welded to the top and bottom portions of the sheet steel shear wall end panels 76, which also serve to act as gusset plates for strap end connections.

Figure 8B:
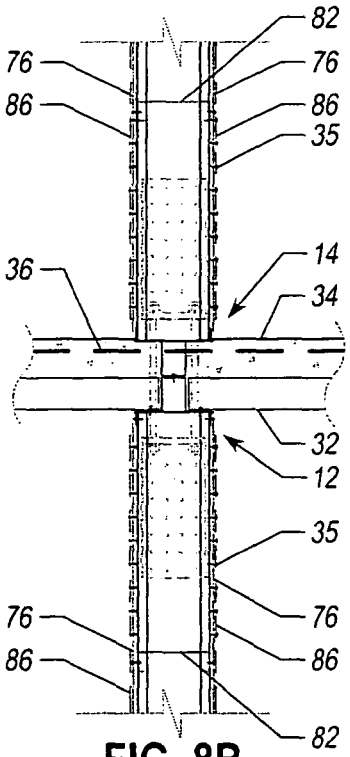

FIG. 8B is a cross-sectional view taken along lines 8B-8B, shown in FIG. 8A. In this view, the bottom spanning track 14 is shown disposed on top of the top spanning track 12, with the steel floor deck 32 and concrete floor topping 34 received between the adjacent sheet steel shear wall end panels and next to the vertical sides 18 and 20 of the two spanning tracks. Though floor system is shown with spanning composite floor deck 32, floors framed with composite steel joists 48 or "C" joists 64 or other similar floor joist systems could also be easily supported by the shear walls 74.

Figure 8C:
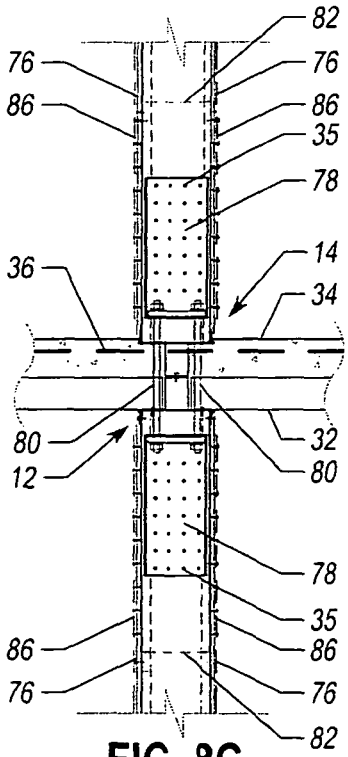

FIG. 8C is a cross-sectional view taken along lines 8C-8C, shown in FIG. 8A. In this drawing, the top and bottom portions of the sheet steel shear wall end panels 76 include "wedge-shaped", shear wall hold-down connectors 78 for receiving threaded hold down bolts 80. The bolts 80 are attached to adjacent brackets 78 for securing the sheet steel shear wall end panels 76 one on top of the other with the floor system and spanning tracks received therebetween. Hold down connectors 78 are screwed to boundary studs 84 with self drilling screws 35.

Figure 8D:
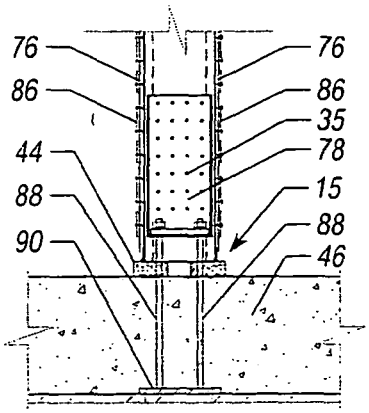

FIG. 8D illustrates a bottom portion of the shear wall 74 at the hold down connector 78, shown supported by foundation or concrete slab 46 at the lowest level. A base track 15 is shown, supported by leveling grout 44 similar to typical bearing walls in FIG. 5D. The base hold down connector 88 is shown as bottom embedded plate 90 at bottom of foundation slab and cast integrally into the foundation or concrete slab 46. Hold down bolts 88 are welded to embedded plate 90 and project out of the slab to allow connection to the hold down connector 78.

These and other objects of the present invention will become apparent to those familiar with the current state of the practice of cold formed steel building construction when reviewing the following detailed description, showing novel construction, combination, and elements as herein described, and more particularly defined by the claims, it being understood that changes in the embodiments to the herein disclosed invention are meant to be included as coming within the scope of the claims, except insofar as they may be precluded by the prior art.

The embodiments of the invention for which an exclusive privilege and property right are claimed and defined as follows:

1. A cold-formed steel, structural, wall and floor framing system for a multi-story building, the framing system adapted for transferring bearing loads from a top of the building, through structural floor levels to a building foundation, the framing system comprising:

a roof structure;

a plurality of spaced apart, vertical upper wall studs, a top portion of the upper studs engaging and supporting the roof structure thereon;

a horizontal, elongated, bottom spanning track with a "U" shaped configuration, the bottom spanning track including a horizontal bottom portion and a pair of parallel, spaced apart, vertical sides, each of the vertical sides having an outwardly extending "L" shaped flange, a bottom portion of the upper wall studs received against the "L" shaped flanges of the bottom spanning track and attached thereto;

a horizontal, elongated, top spanning track with an inverted "U" shaped configuration, the top spanning track including a horizontal top portion and a pair of parallel, spaced apart, vertical sides, each of the vertical sides having an outwardly extending "L" shaped flange;

a plurality of spaced apart, vertical lower wall studs, a top portion of the lower wall studs received against the "L" shaped flanges of the top spanning track and attached thereto; and a horizontal floor, the horizontal bottom portion of the bottom spanning track disposed above and spaced apart from the horizontal top portion of the top spanning track for receiving the horizontal floor therebetween, the horizontal bottom portion of the bottom spanning track engaging a top of the floor and bearing thereon, the horizontal top portion of the top spanning track engaging a bottom of the floor and bearing thereon;

whereby bearing loads from the roof structure are transferred from the upper wall studs to the bottom spanning track, from the bottom spanning track to a portion of the horizontal floor, from the portion of the horizontal floor to the top spanning track, from the top spanning track to the lower wall studs, and from the lower wall studs to the building foundation.

2. The framing system as described in claim 1 wherein the "U" shaped configuration of the bottom spanning track provides a space below the "L" shaped flanges and next to the vertical sides for receiving end portions of a concrete floor topping, the concrete floor topping disposed on top of the horizontal floor.

3. The framing system as described in claim 1 wherein the first and second "L" shaped flanges of the top and the bottom spanning tracks include a deformed flange corner disposed along a length of the flanges for receiving the bearing of the upper and lower vertical wall studs on the spanning tracks.

4. The framing system as described in claim 1 wherein the vertical sides of the top and bottom spanning tracks include spaced apart, elongated embossments therein.

5. The framing system as described in claim 1 wherein the horizontal floor includes a steel floor deck with concrete floor topping and rebar for added floor strength.

6. The framing system as described in claim 1 wherein the horizontal floor includes spaced apart, composite floor joists with top flange hanger arms, one end of the hanger arms attached to the vertical portion of the top spanning track.

7. The framing system as described in claim 1 further including a base spanning track, the base spanning track adapted for receipt on top of the building foundation, a bottom portion of the lower wall studs received on top of the base spanning track and attached thereto.

8. A cold-formed steel, structural, wall and floor framing system for a multi-story building, the framing system adapted for transferring bearing loads from a top of the building, through structural floor levels to a building foundation, the framing system comprising:

a roof structure;

a plurality of spaced apart, vertical upper wall studs, a top portion of the upper studs engaging and supporting the roof structure thereon;

a horizontal, elongated, bottom spanning track with a "U" shaped configuration, the bottom spanning track including a horizontal bottom portion and a pair of parallel, spaced apart, vertical sides, each of the vertical sides having an outwardly extending "L" shaped flange, a bottom portion of the upper wall studs received against the "L" shaped flanges of the bottom spanning track and attached thereto;

a horizontal, elongated, top spanning track with an inverted "U" shaped configuration, the top spanning track including a horizontal top portion and a pair of parallel, spaced apart, vertical sides, each of the vertical sides having an outwardly extending "L" shaped flange;

a plurality of spaced apart, vertical lower wall studs, a top portion of the lower wall studs received against the "L" shaped flanges of the top spanning track and attached thereto;

a base spanning track, the base spanning track adapted for receipt on top of the building foundation, a bottom portion of the lower wall studs received on top of the base spanning track and attached thereto; and a horizontal floor, the horizontal bottom portion of the bottom spanning track disposed above and spaced apart from the horizontal top portion of the top spanning track for receiving the horizontal floor therebetween, the horizontal bottom portion of the bottom spanning track engaging a top of the floor and bearing thereon, the horizontal top portion of the top spanning track engaging a bottom of the floor and bearing thereon;

whereby bearing loads from the roof structure are transferred from the upper wall studs to the bottom spanning track, from the bottom spanning track to a portion of the horizontal floor, from the portion of the horizontal floor to the top spanning track, from the top spanning track to the lower wall studs, and from the lower wall studs to the base spanning track disposed on the building foundation.

9. The framing system as described in claim 8 wherein the "U" shaped configuration of the bottom spanning track provides a space below the "L" shaped flanges and next to the vertical sides for receiving end portions of a concrete floor topping, the concrete floor topping disposed on top of the horizontal floor.

10. The framing system as described in claim 8 wherein the horizontal floor includes a steel floor deck with concrete floor topping and rebar for added floor strength.

11. The framing system as described in claim 8 wherein the horizontal floor includes spaced apart, composite floor joists with top flange hanger arms, one end of the hanger arms attached to the vertical portion of the top spanning track.

12. A cold-formed steel, structural, wall and floor framing system for a multi-story building, the framing system adapted for transferring bearing loads from a top of the building, through structural floor levels to a building foundation, the framing system comprising:

a roof structure;

a plurality of spaced apart, vertical upper wall studs, a top portion of the upper studs engaging and supporting the roof structure thereon;

a horizontal, elongated, bottom spanning track with a "U" shaped configuration, the bottom spanning track including a horizontal bottom portion and a pair of parallel, spaced apart, vertical sides, each of the vertical sides having an outwardly extending "L" shaped flange, a bottom portion of the upper wall studs received against the "L" shaped flanges of the bottom spanning track and attached thereto;

a horizontal, elongated, top spanning track with an inverted "U" shaped configuration, the top spanning track including a horizontal top portion and a pair of parallel, spaced apart, vertical sides, each of the vertical sides having an outwardly extending "L" shaped flange and the horizontal top portion of the top spanning track attached to and received against the horizontal bottom portion of the bottom spanning track for load transfer from the bottom spanning track to the top spanning track;

a plurality of spaced apart, vertical lower wall studs, a top portion of the lower wall studs received against the "L" shaped flanges of the top spanning track and attached thereto; and a horizontal floor, opposite end portions of the horizontal floor received against the vertical sides of the top spanning track;

whereby bearing loads from the roof structure are transferred from the upper wall studs to the bottom spanning track, from the bottom spanning track to a portion of the horizontal floor, from the portion of the horizontal floor to the top spanning track, from the top spanning track to the lower wall studs, and from the lower wall studs to the building foundation.

13. The framing system as described in claim 12 wherein the vertical sides and the "L" shaped flanges of the top spanning track receive the opposite ends of the horizontal floor thereagainst.

14. The framing system as described in claim 13 wherein the "U" shaped configuration of the bottom spanning track provides a space below the "L" shaped flanges and next to the vertical sides for receiving end portions of a concrete floor topping, the concrete floor topping disposed on top of the horizontal floor.

15. The framing system as described in claim 13 wherein the horizontal floor includes a steel floor deck with concrete floor topping and rebar disposed on top of the spaced apart, composite floor joists and attached thereto.

16. The framing system as described in claim 12 wherein the "L" shaped flanges of the top and the bottom spanning tracks include a deformed flange corner disposed along a length of the flanges for receiving the bearing of the upper and lower vertical wall studs on the spanning tracks.

17. The framing system as described in claim 12 wherein the vertical sides of the top and bottom spanning tracks include spaced apart, elongated embossments therein.

* * * * *